US007536820B2

(12) United States Patent
Wade et al.

(10) Patent No.: US 7,536,820 B2
(45) Date of Patent: May 26, 2009

(54) VEHICLE MOUNTED COLLAPSIBLE FIREARM REST

(76) Inventors: Tony Wade, 96 Alford Rd., SE., Rome, GA (US) 30161; Mark Colding, 172 Turner Rd., NE., Rome, GA (US) 30165

( * ) Notice: Subject to any disclaimer, the term of this patent is extended or adjusted under 35 U.S.C. 154(b) by 7 days.

(21) Appl. No.: 11/414,395

(22) Filed: Apr. 28, 2006

(65) Prior Publication Data

US 2006/0248775 A1 Nov. 9, 2006

Related U.S. Application Data

(60) Provisional application No. 60/677,789, filed on May 4, 2005.

(51) Int. Cl.
*F41C 27/00* (2006.01)

(52) U.S. Cl. ..... 42/94

(58) Field of Classification Search ..... 42/94
See application file for complete search history.

(56) References Cited

U.S. PATENT DOCUMENTS

| | | | | |
|---|---|---|---|---|
| 4,501,082 | A | 2/1985 | Phillips | |
| 4,937,965 | A | 7/1990 | Narvaez | |
| 4,972,619 | A | 11/1990 | Eckert | |
| 5,056,410 | A | 10/1991 | Pitts | |
| 5,060,410 | A | 10/1991 | Mueller | |
| 5,070,636 | A | 12/1991 | Mueller | |
| 5,451,088 | A | 9/1995 | Broad | |
| 5,481,817 | A | 1/1996 | Parker | |
| 5,489,110 | A | 2/1996 | Van Dusen | |
| 5,628,135 | A * | 5/1997 | Cady | 42/94 |
| 5,833,308 | A | 11/1998 | Strong | |
| 6,227,517 | B1 * | 5/2001 | Wohl | 248/694 |
| 6,269,578 | B1 | 8/2001 | Callegari | |
| 6,684,550 | B2 | 2/2004 | Highfill | |
| 6,871,440 | B2 | 3/2005 | Highfill | |
| 6,935,064 | B1 * | 8/2005 | Thompson | 42/94 |
| 2002/0168258 | A1 * | 11/2002 | Philipps et al. | 414/462 |
| 2004/0049966 | A1 * | 3/2004 | Highfill et al. | 42/94 |

* cited by examiner

*Primary Examiner*—J. W Eldred
*Assistant Examiner*—Gabriel J Klein
(74) *Attorney, Agent, or Firm*—Thomas, Kayden, Horstemeyer & Risley, LLP

(57) ABSTRACT

Disclosed are vehicle-mounted, collapsible systems for securing, supporting or resting a firearm. A representative embodiment includes a firearm rest, a vertical member and a horizontal member. The horizontal member is connectable to a vehicle hitch. The vertical member firearm rest are collapsible into a substantially parallel configuration relative to the horizontal member.

2 Claims, 3 Drawing Sheets

VEHICLE MOUNTED COLLAPSIBLE FIREARM REST

CROSS REFERENCE TO RELATED APPLICATION

This application claims priority to copending U.S. Provisional Application No. 60/677,789, filed on May 4, 2005, which is entitled, "Tailgate Rifle Rest" and is hereby incorporated by reference in its entirety.

TECHNICAL FIELD

The present disclosure is generally related to firearms and, more particularly, collapsible systems for supporting a firearm.

BACKGROUND

Ensuring the accuracy of a rifle's sighting instrument, such as a scope or other open-sight device, can be a difficult and even potentially dangerous proposition. Historically, hunters and other shooters have sighted in their rifle by firing test rounds to a target at a known distance. Oftentimes, the shooter will position the rifle at a stationary point, which, as a nonlimiting example, may be across the hood of a vehicle or in the tailgate area. Because the vehicle body upon which the rifle is positioned is not designed for receipt of the rifle, the shooter has to find a firing position that provides stability for accurately sighting in the scope or other sighting device.

As a nonlimiting example, if a shooter elects to position the rifle across the hood of a vehicle, the shooter may choose to rest the rifle on a soft surface, such as a jacket or other article of clothing, positioned on top of the hood so as to provide a suitable firing position. Likewise, a shooter may position the rifle on a portion of the back area or sidewall of a truck bed so as to create the desired stationary position.

In each of these instances, a shooter generally cannot necessarily create the same shooting position with each fired round, so as to most accurately sight in the scope. This consequence introduces error and uncertainty into the sighting process.

Situations also exist wherein a rifle or other sighting device may be so grossly out of sight such that the barrel of the rifle is pointed into a direction other than the intended target area during the sighting process. In at least one nonlimiting example, if a rifle scope were so significantly misaligned such that the rifle barrel is pointed into a downward direction, the shooter could unknowingly fire the rifle into the truck hood, other portion of the vehicle, or any other undesired area, which may cause damage to property and/or, even worse, injury to person.

Further, there exist devices in the marketplace which may be used to stabilize or aim a firearm that can be mounted to the rear of a vehicle, often to a vehicle's hitch. However, such devices are often bulky and can consume much of the space in a truck's bed or storage area. Alternatively, it may be such that the device be transported while attached to a vehicle's hitch while fully or partially extended and/or assembled, which provides that the device occupy the vehicle's hitch, eliminating its use for the hauling of other items.

Thus, there is a heretofore unaddressed need to overcome at least the deficiencies and shortcomings described above.

SUMMARY

Embodiments of the present disclosure provide vehicle-mounted, collapsible systems for securing, resting or supporting a firearm. In one embodiment, an apparatus for supporting a firearm includes a telescoping horizontal member having a first end and a second end, the telescoping horizontal member may be connectable at the first end to a vehicle hitch.

The embodiment further includes a telescoping support member, the telescoping support member is coupled to the telescoping horizontal member by a member coupler. The telescoping support member further includes a longitudinal axis and is configured to be adjustably rotatable about the longitudinal axis. The telescoping support member is also further configured to be adjustably rotatable about the member coupler.

The embodiment also includes a firearm rest having a horizontal cross-member. The firearm rest is coupled to the telescoping support member by a firearm rest coupler. The firearm rest is adjustably rotatable about the firearm rest coupler.

In the embodiment, the telescoping support member and the firearm rest are configured to be collapsible onto the telescoping horizontal member by rotating the telescoping support member and the horizontal cross-member into a substantially parallel configuration relative to the telescoping horizontal member.

DETAILED DESCRIPTION

Reference will now be made to the drawings. While the disclosure will be provided in connection with these drawings, there is no intent to limit the disclosure to the embodiment or embodiments disclosed herein. On the contrary, the intent is to cover all alternatives, modifications, and equivalents.

Disclosed herein are systems for a vehicle mounted collapsible firearm rest. An embodiment of the disclosure includes a telescopic horizontal member configured to mate with a tailgate hitch. An embodiment further includes a telescopic support member design to adjustably attach to the telescopic horizontal support member. An embodiment also includes a firearm rest adjustably attached to the telescopic support member.

Figure 1:
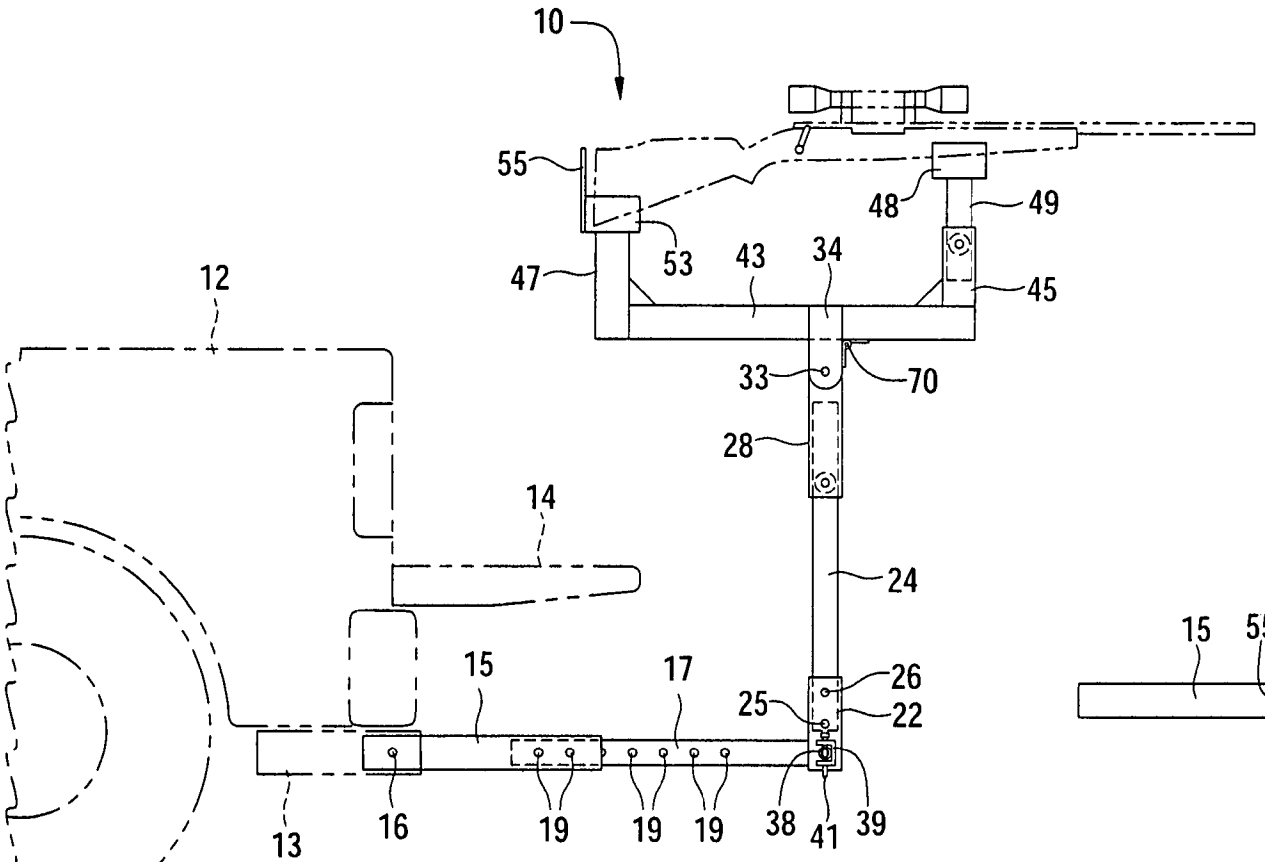
FIG. 1 is a side view of an embodiment of a vehicle mounted collapsible firearm rest.

Reference will now be made to FIG. 1, which depicts a diagram of the vehicle mounted collapsible firearm rest 10 configured to mate with vehicle 12 at vehicle hitch 13. In this nonlimiting example, vehicle mounted collapsible firearm rest 10 comprises a telescoping horizontal member 15 that is received by vehicle hitch 13 and secured by inserting a pin through hole 16, as one of ordinary skill in the art should appreciate. In this way, the vehicle mounted collapsible firearm rest 10 extends in a direction behind vehicle 12 such that a shooter may sit on tailgate 14 and fire a rifle or other firearm using the vehicle mounted collapsible firearm rest 10, as described more thoroughly below.

Telescoping horizontal member 15 is configured to receive sliding member 17 such that one or more holes 19 on each of members 15 and 17 line up to the desired extended position from vehicle 12. Pins can be employed in conjunction with one or more holes 19 to secure the desired extended position from vehicle 12. As a nonlimiting example, pins may be inserted between the holes on member 15 and one of the rightmost holes on member 17 to move the tailgate rifle rest closer to the vehicle 12 for a smaller sized shooter. Conversely, the rightmost holes of member 17 may be positioned away from member 15 so that the tailgate rifle rest is configured for a larger-sized user of the system.

Member 17 is coupled to a member coupler 22 which, in this nonlimiting example, is configured at approximately a 90-degree angle relative to member 17 in one nonlimiting example. However, one of ordinary skill in the art would know that other angles could also be used.

Member coupler 22 may be configured to mate telescoping horizontal member 17 and telescoping support member 24 in an adjustable configuration. Member coupler 22 in this nonlimiting example contains two securing holes 25 and 26 to lock telescoping support member 24 into a position approximately 90 degrees relative to member 17 as well, which also is but one nonlimiting example, among others. In this regard, telescoping support member 24 is adjustably attached to horizontal support member 17 such that the relative angle between the two members can be varied.

Telescoping support member 24 may be further configured in this non-limiting example as a cylindrical member that is rotatable about a longitudinal axis of the member 24. This allows a user to rotate the member 28, as discussed below, in a substantially parallel direction relative to the ground in order to vary the horizontal aiming properties of the vehicle mounted collapsible firearm rest 10. It should be appreciated that pin holes 25, 26 may be used to secure member 24 to member coupler 22. As an additional nonlimiting example, member 24 may have a square section that couples to member coupler 22 via pins through pin holes 25 and 26. Furthermore, member 24 may have a cylindrical section at the end that couples to sliding member 28. Thus, member 24 may be fabricated with both a square and cylindrical section to provide stability and range of motion, as one of ordinary skill would appreciate.

Sliding member 28 may be configured to receive member 24 so as to create the telescoping nature and adjustable height configuration of the telescoping support member 24 for users of the system of differing heights. As discussed above, sliding member 28 may rotate around member 24, which may be cylindrical for the portion that mates with sliding member 28.

Sliding member 28 may likewise be connected to firearm rest coupler 34, which may be coupled to member 28 at pin position 33. One of ordinary skill in the art should appreciate from FIG. 1 that swing portion 34 may rotate around pin position 33 so that a shooter may move the tailgate rifle rest 10 to a desired firing position. As an additional nonlimiting example, an additional pin or other securing device could be used so as to hold swing portion 34 stationary relative to member 28. A second pin through firearm rest coupler 34 and member 28 could be inserted by a user to hold cross-member 43 of the firearm rest in a preset position. Other nonlimiting examples could perform this operation as well, as one of ordinary skill in the art should appreciate.

Firearm rest coupler 34 is likewise coupled to cross-member 43 of the firearm rest, which itself is coupled to members 45 and 47. Member 47 is essentially a vertical member that is itself coupled to rests 53 and 55, which are configured to receive the buttstock of a firearm. More specifically, the buttstock of a firearm may be configured to rest against member 55 so as to absorb any recoil action when firing. In the depicted embodiment, member 55 is configured as a vertical member to absorb recoil of the firearm, and member 55 further assists in preventing potential variations in firearm positioning caused by sudden movements of a firearm due to recoil.

Conversely, member 45 may be connected to extender bar 49 and rest 48, which may be configured to receive a forward portion of the firearm, such as the forward handle or barrel. As depicted, member 45 can be configured as a telescoping adjustable member to allow a user to vary the height and aim of the firearm, depending on the size of the user and the targets at which the user wishes to aim. As noted above, telescoping support member 24 allows a user to adjust the horizontal aiming properties of the apparatus 10, and member 45 can allow the user to adjust the vertical aiming properties of the apparatus 10, giving a user of the system a substantially full range of motion for aiming a firearm used in conjunction with the vehicle mounted collapsible firearm rest 10.

Cross-member 43, as well as front and rear firearm support members 45, 47, are rotatably adjustable relative to member 28. As noted above, a removable pin can be inserted in pin hole 33 to secure the firearm rest in place relative to member 28. If such a removable pin is removed from pin hole 33, members 43, 45, and 47 may be rotatably adjustable about hinge 70, which may assist in providing collapsible functionality of the vehicle mounted collapsible firearm rest 10, and is described in further detail hereinafter.

Also shown in FIG. 1 is footrest 38, which may be coupled to member coupler 22 via footrest coupler 39. In this nonlimiting example, footrest 38 may be hinged about pin 41 so as to collapse, as more thoroughly described below. It should be appreciated that a second footrest can be provided in an identical mirrored configuration on the other side of apparatus 10 for the user's other foot despite the fact it is not depicted in FIG. 1.

According to the vehicle mounted collapsible firearm rest 10 described above, members 15 and 17 extend essentially horizontally from the rear portion of vehicle 12, as coupled to vehicle hitch 13. Similarly, members 28 and 24 are configured to extend essentially vertically so that the shooter may position a firearm in receiving portions 48, 53, and 55.

Figure 2:
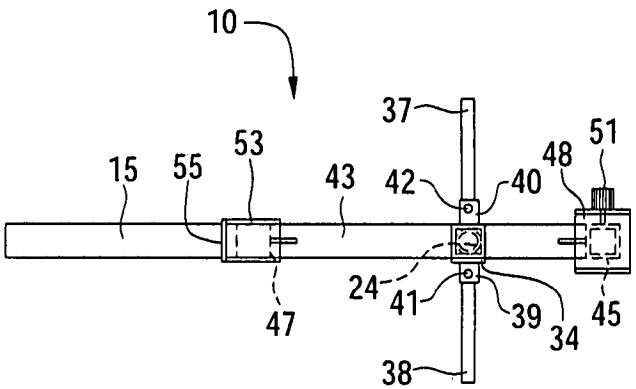
FIG. 2 is a top view of an embodiment of a vehicle mounted collapsible firearm rest of FIG. 1.

FIG. 2 depicts a top view of the vehicle mounted collapsible firearm rest 10 of FIG. 1. As noted above, member 45 can be configured as a telescoping adjustable member to allow a user to vary the height and aim of the firearm, depending on the size of the user and the targets at which the user wishes to aim. To facilitate adjustment of the vertical aim of a firearm, FIG. 2 also depicts adjustable knob 51, which the shooter may use to extend the height of bar 49 from member 45. Depending on the particular firearm the shooter uses with the tailgate rifle rest 10, the shooter may raise or lower bar 49 and receiver 48 via knob 51 for various rifle configurations to ensure a proper shooting position.

FIG. 2 further depicts footrests 37, 38 coupled to the apparatus 10 by footrest couplers 39, 40. Footrests 37, 38 allow a user sit on a tailgate section of a vehicle (14 of FIG. 1) and place his or her feet on footrests 37, 38 when aiming a firearm or using the apparatus 10. FIG. 2 also depicts front and rear firearm receiving portions 48, 53, and 55, which can be sized to accept the buttstock or rear of a firearm as well as the barrel or front of a firearm. Further, padded material can be placed within the receiving portions to further assist in absorbing recoil of a firearm that results from firing.

Figure 3:
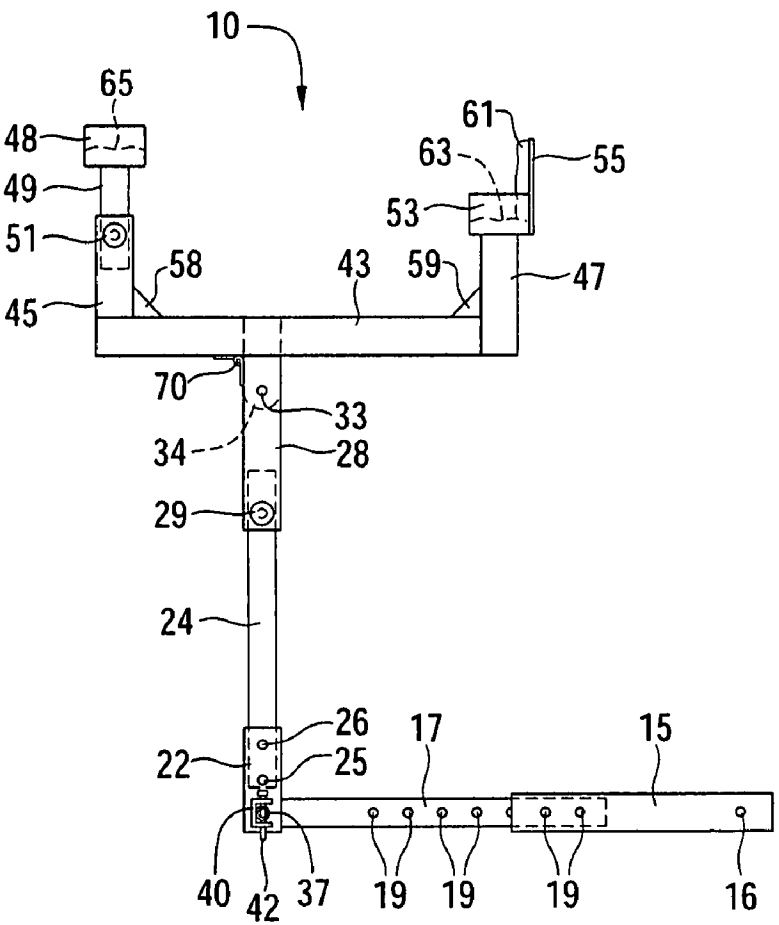
FIG. 3 is a side view of an embodiment of a vehicle mounted collapsible firearm rest of FIG. 1.

Reference is now made to FIG. 3, which depicts a side view of a vehicle mounted collapsible firearm rest 10 of FIG. 1. FIG. 3 depicts padded material 65 with member 48, which can be configured to support and cushion the barrel or front of a firearm. Padded material 65 can also absorb recoil of a firearm that is caused when a firearm is fired. Also depicted is padded material 63 coupled to member 53 and padded material 61 coupled to vertical member 55 of the firearm rest. Again, padded materials 61, 63 can absorb recoil of the firearm resulting from its firing and assist in the accurate positioning of the firearm. These pads and cushions operate to protect the finish on the firearm, as well as to absorb any recoil from the firing of the firearm. FIG. 3 also depicts supplementary support members 58, 59, which may be configured to enhance the stability of a vehicle mounted collapsible firearm rest 10 and a firearm used in conjunction with the apparatus.

This nonlimiting example in FIG. 3 also depicts hinge 70 which may be coupled between sliding member 28 and cross-member 43 for the folding and/or compaction of the tailgate rifle rest to a travelling position. This is but one nonlimiting example, as in an alternative example described more thoroughly below in reference to FIG. 7. Nevertheless, one of ordinary skill in the art would understand that member 43 may be rotated about hinge 70 to a collapsed position against sliding member 28 when the tailgate rifle rest 10 is folded for storage.

Figure 4:
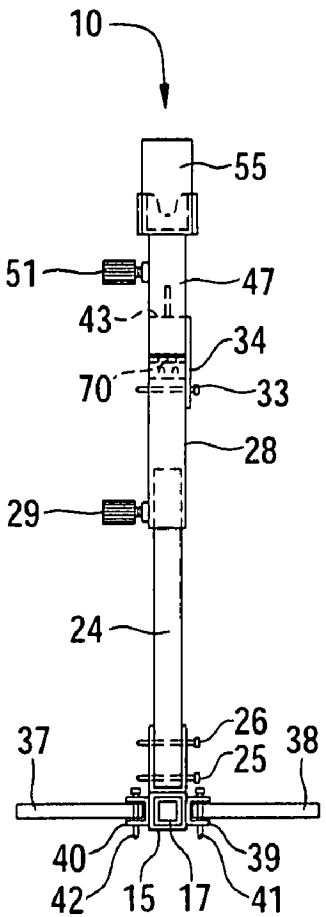
FIG. 4 is a front view of an embodiment of a vehicle mounted collapsible firearm rest of FIG. 1.

Reference is now made to FIG. 4, which depicts a front view of a vehicle mounted collapsible firearm rest 10 of FIG. 1. FIG. 4 depicts removable pins at locations 25, 26, which can secure telescoping support member 24 to member coupler 22 of FIG. 3. Also depicted is a removable pin 33, which secures firearm rest coupler 34 and cross-member 43 in an upright configuration, with cross-member 43 substantially perpendicular to members 24, 28.

FIG. 4 further depicts adjustable knob 29, which, along with sliding member 28 and telescoping support member 24, provides telescoping functionality and height adjustment characteristics of the apparatus 10. Adjustable knob 29 can be disengaged from telescoping support member 24 to allow the sliding member 28 to be raised or lowered, depending on the size of the user and the desired height of the apparatus 10. Stated another way, the shooter may tighten or loosen adjustable device 29 so as to control the amount of member 24 contained within member 28, which therefore affects the height of the apparatus 10.

Finally, adjustable knob 29 is shown in this figure for controlling the height of the tailgate rifle rest relative to support telescoping support member 24. As described above, the vehicle mounted collapsible firearm rest 10 may be coupled to the vehicle hitch 13 of vehicle 12 so that a rifle may be positioned in receivers 48 and 53 for target practice, sighting in a rifle scope, or even other firing activities, as one of ordinary skill in the art would know. The adjustability of tailgate rifle rest 10 as described above via the various adjustment devices and slidable members, enables tailgate rifle rest 10 to be utilized by virtually any shooter of any age or size.

Figure 6:
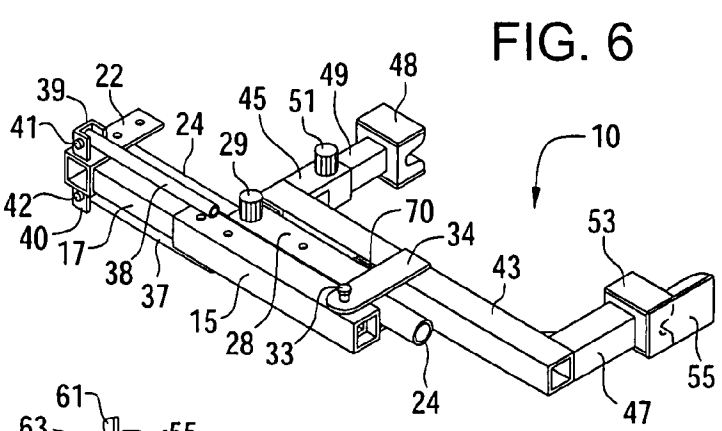
FIG. 6 is a perspective view of an embodiment of the vehicle mounted collapsible firearm rest in a collapsed configuration of FIG. 1.
Figure 5:
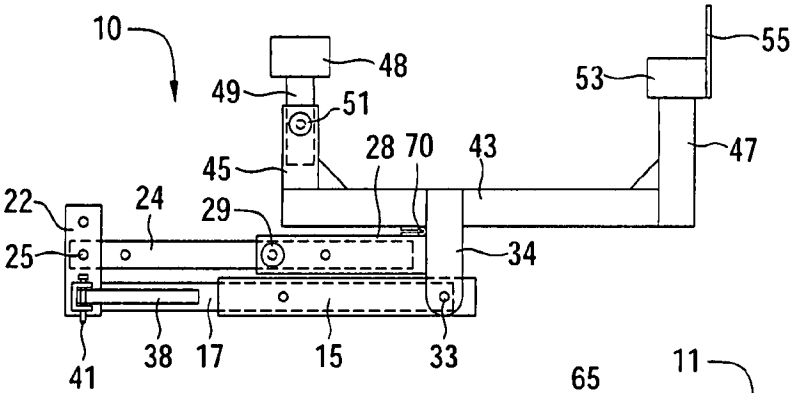
FIG. 5 is a side view of an embodiment of the vehicle mounted collapsible firearm rest in a collapsed configuration of FIG. 1.

FIGS. 5 and 6 depict collapsed positions of the vehicle mounted collapsible firearm rest 10 as described in FIGS. 1-4. In this nonlimiting example, horizontal telescoping member 15 and sliding member 17 may be positioned such that member 15 houses a maximum portion of member 17, thereby shortening the overall length of the two members 15 and 17. Likewise, sliding member 28 may be configured to house a maximum portion of telescoping support member 24, so as to shorten its length to a desired collapsed position.

Upon removal of pin 26 of FIG. 4, member 24 may rotate about pin 25 in supporting member 22 such that members 24 and 28 are substantially parallel to members 15 and 17, as shown in FIG. 5. As described above, footrests 37, 38 may be swung to a closed position substantially parallel to member 17.

Pin 33 may be removed such that swing member 34 may be detached from supporting member 28 and repositioned in hole 16 of member 15, as shown in FIG. 5. This repositioning of firearm coupler 34 such that pin 33 is inserted through hole 16 enables cross-member 43 to be essentially parallel with members 15 and 17, as shown in FIG. 5. As noted above, hinge 70 allows the firearm coupler 34, cross-member 43 as well as members 45, 47 and additional firearm supporting members discussed above, to swing to a substantially parallel configuration relative to members 15 and 17 while remaining attached to sliding member 28. In this way, the vehicle mounted collapsible firearm rest 10 is collapsed to its smallest position for storage and/or transport, as one of ordinary skill in the art would know.

FIG. 6 is a perspective view of the collapsed position of vehicle mounted collapsible firearm rest 10, as shown in FIG. 5. In this non-limiting example, firearm rest coupler 34 and cross-member 43 are positioned to be completely separable from sliding member 28 so as to be repositioned in hole 16 (FIG. 7) of member 15, which thereafter holds members 24 and 28 in the position shown in FIG. 6.

Figure 7:
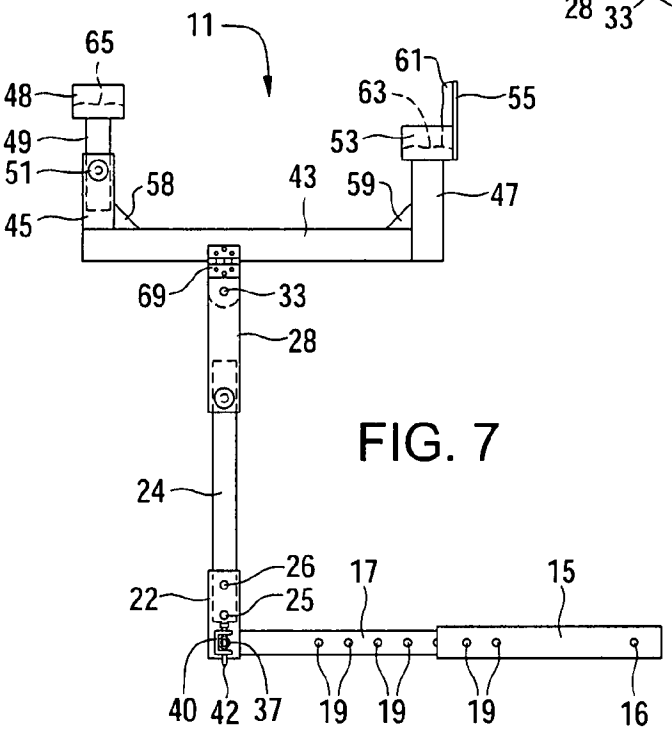
FIG. 7 is a side view of an alternative embodiment of the vehicle mounted collapsible firearm rest of FIG. 1.

FIG. 7 depicts an alternative embodiment 11 of a vehicle mounted collapsible firearm rest. It should be appreciated from the drawing that the apparatus 11 includes a hinge 69 located in a different position relative to the embodiment of FIGS. 1-6. It should also be appreciated that the varying hinge location can cause the apparatus to be collapsible in a different manner while retaining the same or similar features of the embodiment of FIGS. 1-6. It should be appreciated that hinge 69 causes the cross-member 43 to swing into a substantially perpendicular configuration relative to members 24, 28 as well as members 15 and 17. However, the apparatus 11 still retains the collapsible characteristics and portability of the embodiment of FIGS. 1-6.

The vehicle mounted collapsible firearm rest 10, 11 as described herein, may be constructed of any material as one of ordinary skill in the art would know. Metals, plastics, and other composites may be utilized for the vehicle mounted collapsible firearm rest 10, 11 so as to support a firearm and any stresses introduced by the shooter. Moreover, one of ordinary skill in the art would know that a combination of materials may be utilized for the various components as described above, of vehicle mounted collapsible firearm rest 10.

It should be emphasized that the above-described embodiments and nonlimiting examples are merely possible examples of implementations, merely set forth for a clear understanding of the principles disclosed herein. Many variations and modifications may be made to the above-described embodiment(s) and nonlimiting examples without departing substantially from the spirit and principles disclosed herein. All such modifications and variations are intended to be included herein within the scope of this disclosure and protected by the following claims.

Having thus described the invention, at least the following is claimed:

1. An apparatus for supporting a firearm, comprising:

a first horizontal member having a first end and a second end, the first end received by a vehicle hitch and secured by inserting a pin through a hole in both the vehicle hitch and the first horizontal member;

a first sliding member having a first end and a second end, the first end received by the second end of the first horizontal member, such that one or more holes in each of the members line up and are secured with pins to a desired extended position from a vehicle;

the second end of the first sliding member coupled to a member coupler, wherein the member coupler is configured at an about 90 degree angle relative to the first sliding member;

a support member having a cylindrical member and a square section coupled to the member coupler such that one or more securing holes in the member coupler is locked via pins to the square section of the support member into a position about 90 degrees relative to the first sliding member;

a footrest coupled to the member coupler via a footrest coupler and hinged about a pin so as to collapse;

a second sliding member having a first end and a second end, the first end received by the cylindrical member of the support member, and the second sliding member having an adjustable knob at its first end, which can be disengaged from the support member to allow the second sliding member to be raised or lowered;

a firearm rest coupler having a first end and a second end, the first end coupled to the second end of the second sliding member;

the second end of the firearm rest coupler coupled to a horizontal cross-member of a firearm rest having a first end and a second end;

a hinge coupled between the second sliding member and the cross-member;

a first vertical member having a first end and a second end, the first end coupled to the first end of the cross-member of the firearm rest;

the second end of the first vertical member coupled to a horizontal rest and a vertical rest configured to receive the buttstock of a firearm the horizontal rest coupled to a first padded material;

the vertical rest coupled to a second padded material;

an adjustable second vertical member having a first end and a second end, the first end coupled to the second end of the cross-member of the firearm rest;

the second end of the adjustable second vertical member coupled to an extender bar and a second horizontal rest configured to receive a forward portion of a firearm;

a second adjustable knob coupled to the second vertical member and the extender bar; and a third padded material coupled to the second horizontal rest and configured to support and cushion the barrel of front of the firearm.

2. The apparatus of claim 1, further comprising:

a first supplementary support member coupled to the first vertical member and the cross-member of the firearm rest at a 45 degree angle; and a second supplementary support member coupled to the second vertical member the cross-member of the firearm rest at a 45 degree angle.

* * * * *